US010487587B2

(12) United States Patent
Cummins

(10) Patent No.: US 10,487,587 B2
(45) Date of Patent: Nov. 26, 2019

(54) METHODS FOR DRILLING AND PRODUCING A SURFACE WELLBORE

(71) Applicant: SCHLUMBERGER TECHNOLOGY CORPORATION, Sugar Land, TX (US)

(72) Inventor: Ray Cummins, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 35 days.

(21) Appl. No.: 15/632,746

(22) Filed: Jun. 26, 2017

(65) Prior Publication Data

US 2018/0371840 A1 Dec. 27, 2018

(51) Int. Cl.

| | |
|---|---|
| ***E21B 33/035*** | (2006.01) |
| ***E21B 7/20*** | (2006.01) |
| ***E21B 10/61*** | (2006.01) |
| ***E21B 21/10*** | (2006.01) |
| ***E21B 47/01*** | (2012.01) |
| ***E21B 7/18*** | (2006.01) |
| ***E21B 23/02*** | (2006.01) |
| ***E21B 33/06*** | (2006.01) |
| *B05B 1/00* | (2006.01) |
| *E21B 34/00* | (2006.01) |

(52) U.S. Cl.

CPC ..... *E21B 7/20* (2013.01); *E21B 7/18* (2013.01); *E21B 10/61* (2013.01); *E21B 21/10* (2013.01); *E21B 23/02* (2013.01); *E21B 33/035* (2013.01); *E21B 33/06* (2013.01); *E21B 47/01* (2013.01); *B05B 1/00* (2013.01); *E21B 34/00* (2013.01)

(58) Field of Classification Search

CPC ..... E21B 33/038

See application file for complete search history.

(56) References Cited

U.S. PATENT DOCUMENTS

| | | | | |
|---|---|---|---|---|
| 6,920,942 | B2 | 7/2005 | Koederitz | |
| 2004/0140124 | A1* | 7/2004 | Fenton | B01D 17/0211 175/7 |
| 2004/0140125 | A1* | 7/2004 | Dezen | B01D 17/0211 175/7 |
| 2011/0284237 | A1* | 11/2011 | Baugh | E21B 17/06 166/365 |

(Continued)

*Primary Examiner* — Shane Bomar

(74) *Attorney, Agent, or Firm* — Rachel E. Greene

(57) ABSTRACT

A method for drilling and producing a surface wellbore. The method can include drilling a conductor pipe borehole; installing a conductor pipe within the conductor pipe borehole; installing a drilling flange onto the conductor pipe; and assembling a wellhead stack on the drilling flange. The wellhead stack can include two or more blow out preventers, a kill line hub secured to and in fluid communications with a first spool located below a first blowout preventer, a choke line hub secured to and in fluid communications with a second spool located between a second blowout preventer and the first blow out preventer, a choke line, and a kill line, wherein both the kill line and choke line each have a quick connect collet connector. The kill line collet connector can be landed on the kill line and the choke line collet connector on the choke line hub. Each collet connector can be actuated to bring a throughbore in the choke line hub and the kill line hub into sealing engagement with each collet connector throughbore.

7 Claims, 9 Drawing Sheets

(56) References Cited

U.S. PATENT DOCUMENTS

| | | | | |
|---|---|---|---|---|
| 2014/0000902 | A1* | 1/2014 | Wolfe | E21B 33/063 166/361 |
| 2014/0332221 | A1* | 11/2014 | Coppedge | E21B 33/038 166/340 |
| 2014/0345940 | A1 | 11/2014 | Milner et al. | |

* cited by examiner

METHODS FOR DRILLING AND PRODUCING A SURFACE WELLBORE

BACKGROUND

Field

Embodiments described generally relate to methods for operating and producing a surface wellbore for oil and gas production. More particularly, such embodiments generally relate to methods for assembling a wellbore stack assembly for onshore oil and gas production.

Description of the Related Art

In oil and gas production, a wellhead is a structural and pressure-containing, interface to a well for the drilling and production equipment. A wellhead is typically welded onto the first string of casing, which has been cemented in place during drilling operations, to form an integral structure of the well. A valve stack that includes one or more isolation valves, commonly known as a xmas tree or Christmas tree, is installed on top of the wellhead to control the surface pressure. This stack can further include choke and kill equipment to control the flow of well fluids during production. A typical wellhead system includes a casing head, casing spools, casing hangers, packoffs (isolation) seals, test plugs, mudline suspension systems, tubing heads, tubing hangers, and a tubing head adapter.

A kill line typically has a valve and tubing/piping connected between one or more mud pumps or other fluid delivery pumps and a connection below a blowout preventer to facilitate the pumping of fluid into the well when a well blowout preventer is closed. A choke line typically has a line leading from an outlet on the blowout preventer to a back-pressure choke and associated manifold. During normal control operations, fluid is pumped through the kill line down the drillstring and annular fluid is taken out of the well through the choke and choke line which drops the fluid pressure, typically to at or near atmospheric pressure.

During well drilling and production preparations, wellhead systems are typically installed and removed several times. In particular, the removal and replacement of the kill lines and choke lines are tedious and time consuming. The choke and kill line valves, for example, are bolted to a flexible hose or hard piping that make up the rest of the choke or kill lines. The time to complete the connection process can be immense. For example, for a typical 3 1/16 10,000 API manual flange connection there are typically 8 bolts that are needed to make up the connection. Known bolt torque specifications call for five different runs with a hydraulic torque wrench to make up the connection. Once at 25% of the recommended torque pre-load value, then 50%, 75% and then 100%, followed by a check of applying 100% again. These time sensitive installations can be expensive.

During drilling or production operations, various components of the wellhead assembly are removed and replaced, necessitating the removal of the various components of the wellhead stack. There is a need, therefore, for an improved method for removing and replacing connections to a wellhead assembly while still providing safe, secure connections between the well and its drilling and/or operations components such as the kill and choke lines, blowout preventers, Christmas trees, and the like.

SUMMARY

A method for drilling and producing a surface wellbore. The method can include drilling a conductor pipe borehole; installing a conductor pipe within the conductor pipe borehole; installing a drilling flange onto the conductor pipe; and assembling a wellhead stack on the drilling flange. The wellhead stack can include two or more blow out preventers, a kill line hub secured to and in fluid communications with a first spool located below a first blowout preventer, a choke line hub secured to and in fluid communications with a second spool located between a second blowout preventer and the first blow out preventer, a choke line, and a kill line. Both the kill line and choke line each have a quick connect collet connector. The kill line collet connector can be landed on the kill line and the choke line collet connector on the choke line hub. Each collet connector can be actuated to bring a throughbore in the choke line hub and the kill line hub into sealing engagement with each collet connector throughbore. A wellbore can be drilled by introducing a drill head and drill string into the conductor pipe borehole, rotating the drill string, removing the drill string and drill head, installing casing, cementing the casing, and plugging the bottom of the casing.

A method for installing a wellhead stack is also provided. A wellhead stack is located on a drilling flange. The wellhead stack includes blow out preventers, a kill line hub secured to and in fluid communications with a spool located below a first blowout preventer, a choke line hub secured to and in fluid communications with a spool located between a second blowout preventer and the first blow out preventer. The stack further includes a choke line, and a kill line. Both the kill line and choke line each have a quick connect collet connector. The kill line collet connector is landed on the kill line and the choke line collet connector on the choke line hub.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
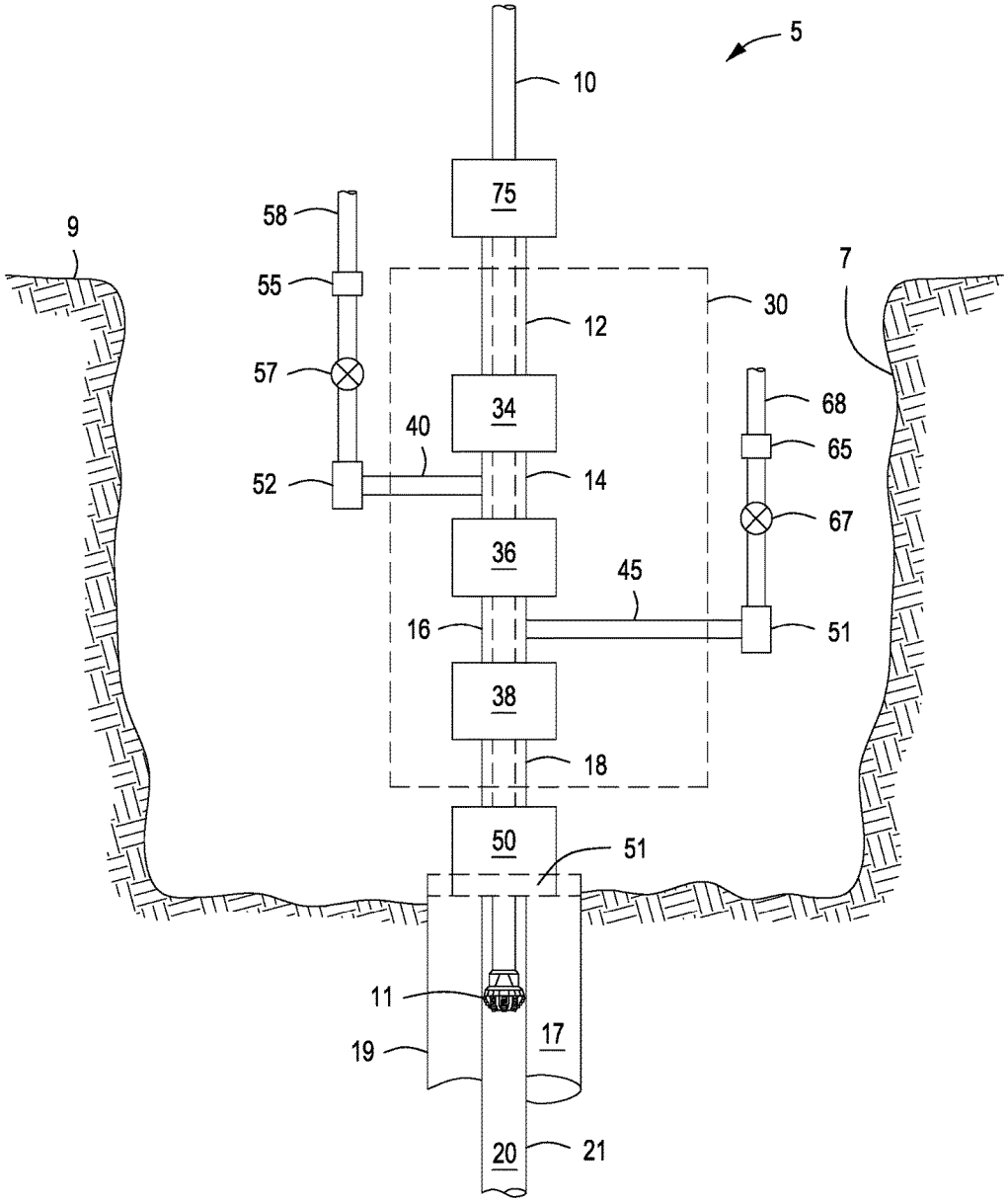
FIG. 1 depicts an illustrative surface wellbore assembly, according to one or more embodiments provided herein.

FIG. 1 depicts an illustrative surface wellbore assembly 5 for drilling and production, according to one or more embodiments provided herein. The wellbore assembly 5 can include any number of valves, blowout preventers, casing spools, hangers, seals, studs, nuts, ring gaskets, and other associated components and accessories conventionally used to provide a structural and pressure-containing interface for drilling and production equipment. For example, the wellbore assembly 5 can include a blowout preventer stack (BOP stack) 30 that can include one or more blowout preventers (three are shown 34, 36, 38) secured to and in fluid communications with each other via one or more tubular spools 12, 14, 16.

A choke line hub 40 can be connected to and in fluid communication with the BOP stack 30. For example, the choke line hub 40 can be connected at an upper or second spool 14 located between the second and third blowout preventers 36, 34. A quick connect collet connecter 52 can be used to connect the choke line 58 and choke valve 57 to the choke line hub 40. The choke line 58 can be connected to the choke valve 57 via a flange 55.

A kill line hub 45 can be connected to and in fluid communication with the BOP stack 30. For example, the kill line hub 40 can be connected at a lower or first spool 16 located between the first and second blowout preventers 38, 36. A kill line 68 and kill valve 67 can be installed on and in fluid communication with the kill line hub 45 via a quick connect collet connector 51. The kill line 68 can be connected to the kill valve 67 via a flange 65.

Figure 8:
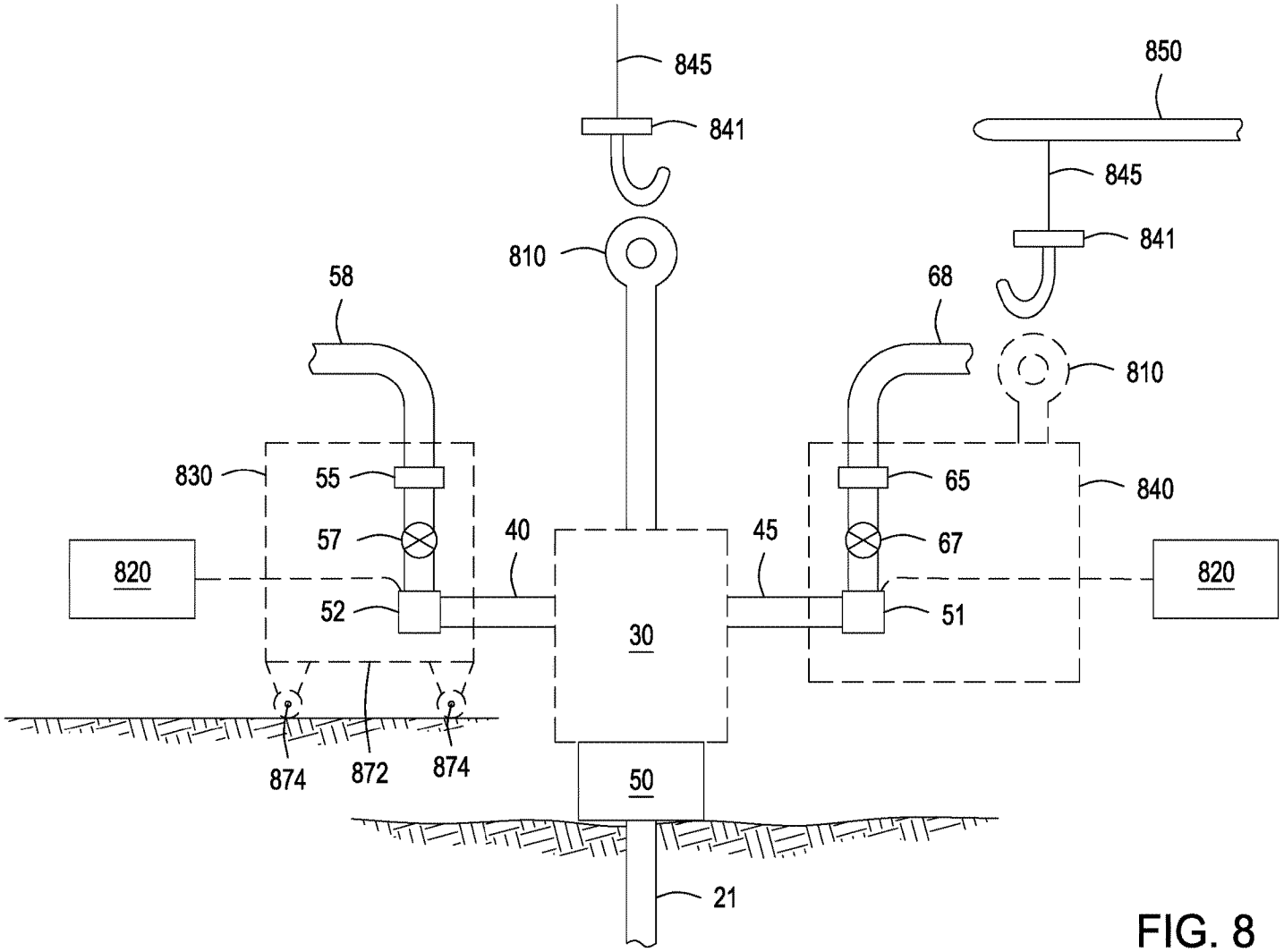
FIG. 8 depicts the illustrative wellbore stack secured to a wellbore during well drilling, well operations, or well workover, according to one or more embodiments provided herein.

For onland wellbores, the wellbore assembly 5 can be located at least partially within a drilling cellar 7 that is excavated or dug below the surface or ground 9. The drilling cellar 7 can be lined with wood, cement, pipe, or other materials. The depth of the cellar 7 can be excavated such that a master valve on a Christmas tree is accessible from ground level. The wellbore assembly 5 also can be located directly on the surface 9 without the need for a drilling cellar 7. FIG. 8 depicts this configuration.

If a drilling cellar 7 is used, a conductor pipe borehole 19 can be drilled below the drilling cellar 7 and a conductor pipe 17 can be installed within the conductor pipe borehole 19 and cemented in. A drilling flange 51 can be installed on the surface side of the conductor pipe 17. The BOP stack 30 can be installed directly on the drilling flange 51.

A wellbore 21 can be drilled within and below the conductor pipe borehole 19 by introducing a drill string 10 and a drill head 11 into the conductor pipe borehole 19, and rotating the drill string 10 and drill head 11 with a rotary table 75, drilling into the ground 9 within the drilling cellar 7 until a desired depth is reached. A casing 20 can be installed within the wellbore 21. The casing 20 can be cemented in, and plugged at the bottom. The casing 20 can be a pipe installed within the borehole 19 and can prevent contamination of fresh water well zones along the borehole 19, prevent unstable formations from caving in, isolate different zones within the borehole 19, seal off high-pressure zones from the surface, prevent fluid loss into or contamination of production zones within the borehole 19, and provide a smooth internal bore for installing production equipment.

The BOP stack 30 can be removed from the drilling flange 51 and a casing head housing 50 can be installed on the casing 20. The casing head housing 50 can be an adapter between the casing 20 and either the BOP stack 30 during drilling or the Christmas tree, not shown, after well completion. This adapter can be threaded or welded onto the casing 20 and may have a flanged or clamped connection to match the BOP stack 30 connection configuration. The BOP stack 30 can be installed on a casing spool 18 installed on the casing head housing 50.

The choke line 58 and the kill line 68 can be installed on the BOP stack 30 by landing the kill line collet connector 51 on the kill line hub 45, and landing the choke line collet connector 52 on the kill line hub 40. Each collet connector 51, 52 can then be activated to bring a throughbore in the choke line hub 40 and the kill line hub 45 into sealing engagement with the through bore of each collet connector such that the choke line valve 57 and the kill line valve 67 can each separately control fluid flow through the choke line hub 40 and the kill line hub 45, respectively.

Each blowout preventer 34, 36, 38 can be the same of can differing from one another. For example, each BOP can be an annular type, a shear-blind type, or a pipe preventer type. The annular blowout preventer type can include a large valve used to control wellbore fluids. In this blowout preventer type, the sealing element can resemble a large rubber doughnut that is mechanically squeezed inward to seal on either casing 20 (drill collar, drillpipe, casing, or tubing) or the wellbore 21. The blind shear ram blowout preventer type can include a closing element fitted with hardened tool steel blades designed to cut the casing 20 when the blowout preventer is closed, and then fully close to provide isolation or sealing of the wellbore. The pipe ram blowout preventer type can include a sealing element with a half-circle hole on the edge (to mate with another horizontally opposed pipe ram) sized to fit around casings such as casing 20.

Considering the choke line 58 in more detail, a choke valve 57 can be secured and in fluid communications with the choke line hub 40 via a choke line connector 52 where choke line connector 52 is configured to connect to the choke line hub 40. A choke line 58 can be secured to the choke valve 57 via the flange 55.

Considering the kill line 68 in more detail, a kill valve 67 can be secured to the kill line hub 45 via kill line connector 51 where kill line connector 51 is configured to connect to the kill line hub 45. The kill line 68 can be secured to the kill valve 67 via a flange 65. The choke line 68 and kill line 58 can be rigid tubing or pipe, semi-rigid tubing or pipe, and/or flexible tubing or pipe. The connectors 51 and 52 can be any combination of collect connectors, dog in window style connectors, clamp style connector or other known connectors and can be hydraulically actuated, manually actuated, or electrically operated. The entire assembly of BOP stack 30, with kill valve 67 and choke valve 57 can be reconfigured to support various well drilling and production activities.

During drilling operations, drilling mud can be pumped into the borehole 19 through the drill string 10 to cool the drill head 11 and to control formation pressures within the borehole 19. Formation pressures within the borehole 19 can be measured to determine if the formation pressure exceeds the pressure from the drilling mud. If the formation pressure exceeds the mud pressure, drilling can be discontinued, at least one blow out preventer can be closed, and the choke line valve 57 can be adjusted to stabilize the downhole pressure. Various drilling mud densities can be introduced into the borehole 19 through the kill line 68 to stabilize the downhole pressure and to flow the pressure differential out of the borehole 19 through the choke valve. Once the pressure differential has been stabilized, drilling can be restarted.

Figure 2:
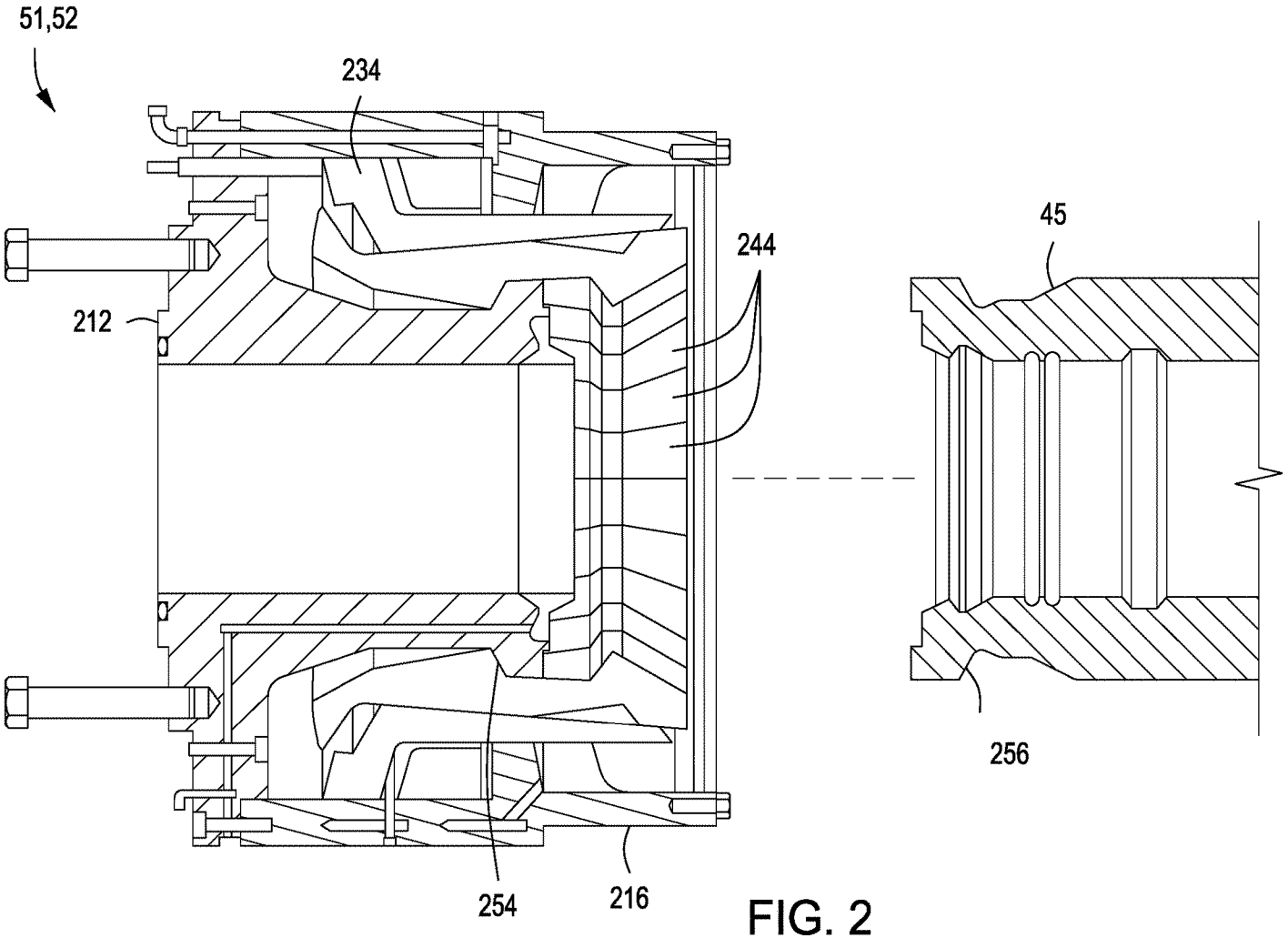
FIG. 2 depicts an illustrative partial section view of the kill line connector and kill line hub that can be used in both the choke line and the kill line to provide a quick and easy connect/disconnect with the wellbore stack assembly, according to one or more embodiments provided herein.

FIG. 2 depicts an illustrative partial section view of the kill line connector 51 and kill line hub 45 or choke line hub 40 that can be used in both the choke line 58 and the kill line 68 to provide a quick and easy connect/disconnect with the wellbore assembly 5, according to one or more embodiments. Connectors 51 and 52 can be a hydraulically actuated collet connector. The collet connector can include a body 216, latching fingers 244, and an actuator ring or operating piston 234. The collet connector can secure in fluid communication a first tubular member 112 to a second tubular member or hub 45 by introducing mechanical forces to a tapered shoulder 254 and a tapered shoulder or hub profile 256.

Figure 3:
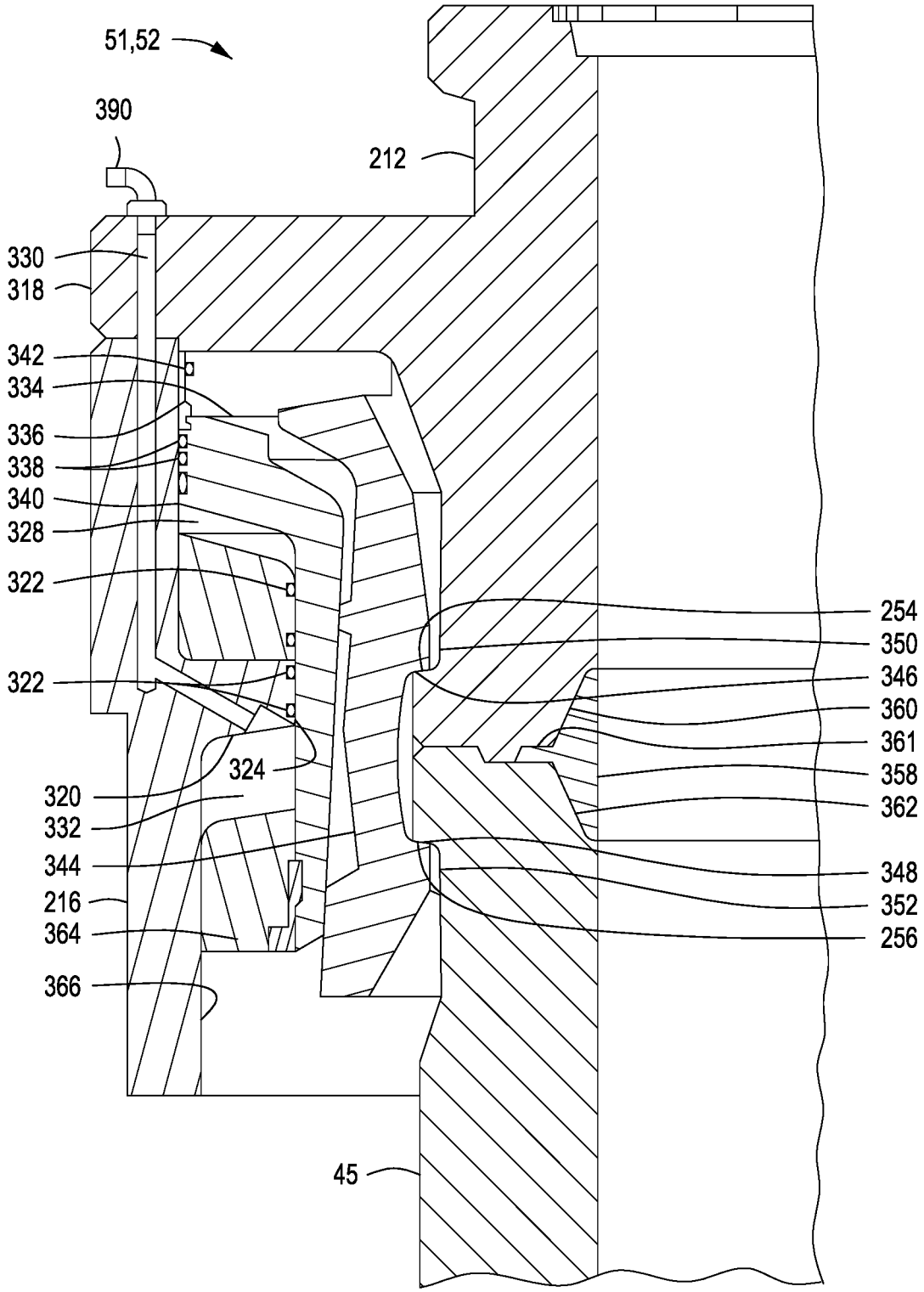
FIG. 3 depicts a section view of an illustrative collet connector in its locking position, according to one or more embodiments provided herein.
Figure 4:
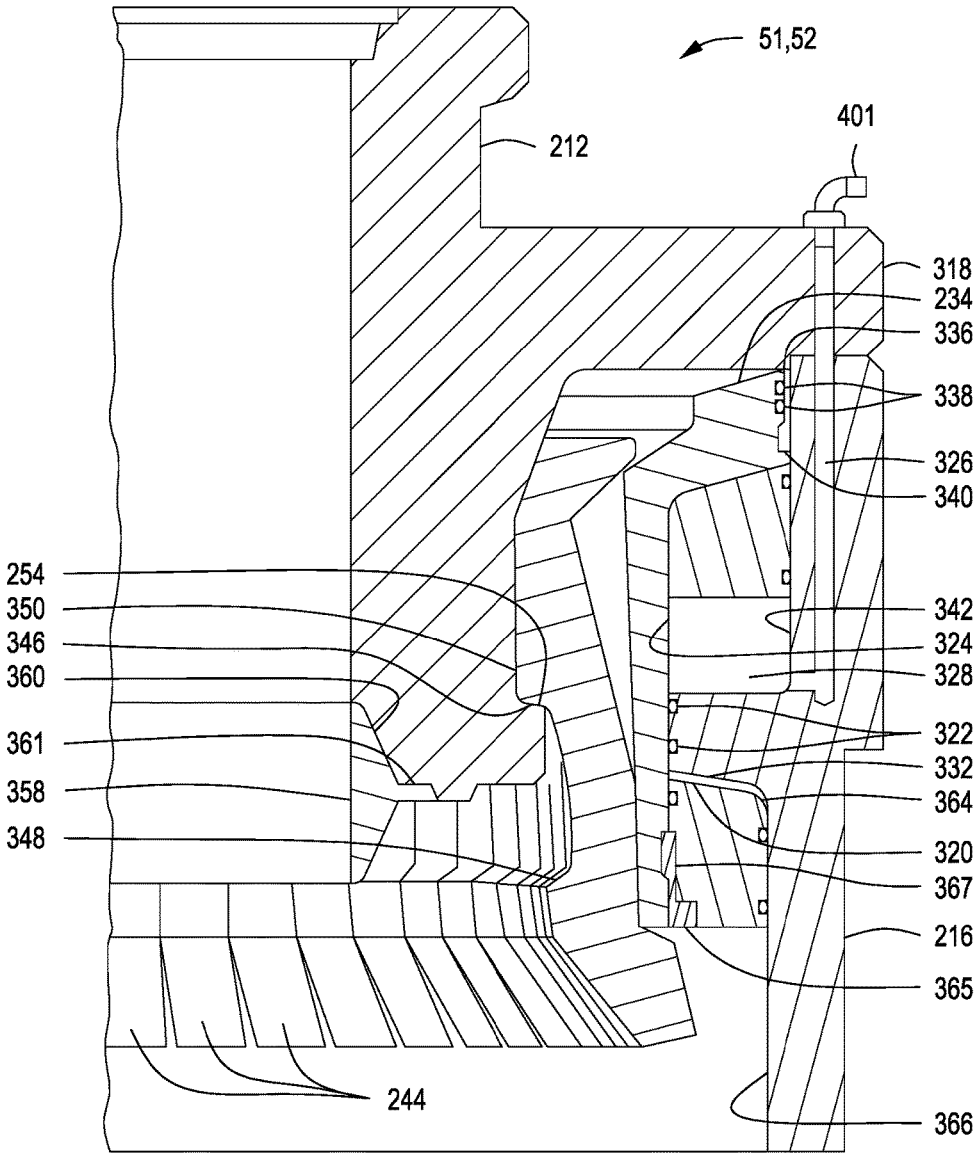
FIG. 4 depicts a section view of the illustrative collect connector in its open position, according to one or more embodiments provided herein.

FIG. 3 depicts a section view of an illustrative collet connector in its locking position, according to one or more embodiments. The illustrative connector 51, 52 can be a remotely actuated collet connector or a manually operated collet connector. As depicted, the connector 51, 52 is in its locking position joining first tubular member 212 to the hub 45. FIG. 4 depicts a section view of the illustrative collect connector in its open position, according to one or more embodiments. The connector 51, 52 is depicted mounted on the first tubular member 212 but with the hub 45 re-moved.

The connector 51, 52 can include housing 216 secured to flange 318 of first tubular member 212 and extending axially in surrounding relationship over the position into which the hub 45 is positioned for the connection. Upper and lower annular operating cylinders 328 and 332 are bounded by annular lip 320 of housing 216 which extends inwardly from housing 216 and includes seals 322, such as O rings, positioned in grooves on the inner surface 324 of lip 320. Passage 326 extends through flange 318 and through housing 216 and opens into upper cylinder 328 above lip 320 such that a fluid can be introduced to the upper cylinder 328 through an open port 401. Passage 330 extends through flange 318 and through housing 216 and opens into lower cylinder 332 on the opposite side of lip 320 from cylinder 328 such that a fluid can be introduced to the lower cylinder 332 through a close port 390. Actuator ring 234 can be positioned within housing 216 and includes flange 336 extending outwardly with seals 338 in its outer surface 340 to seal against the upper inner surface 342 of housing 216.

Latching fingers or segments 244 are positioned within actuator ring 234 and are closely spaced together. Latching fingers 244 include shoulders 346 and 348 on projections 350 and 352 and are adapted to engage and secure tapered shoulders 254 and 256 on first tubular member 212 and hub 45.

Seal ring 358 is positioned between the inner ends of first tubular member 212 and hub 45 and seals against the inner tapered surfaces 360 and 362 of member 212 and hub 45, respectively. Seal ring or gasket 358 includes outer diameter enlargement 361 which is used to secure seal ring 358 to first tubular member 212 by suitable means such as bolting, welding, epoxy, or other known means (not shown).

Cylinder head ring 364 is secured to the exterior surface of actuator ring 234 at its lower outer end; is suitably attached thereto by retainer 365 and split ring 367; and is sealed to the lower interior surface 366 of housing 216 and to actuator ring 234 as shown. Retainer ring 365 is secured by bolting (not shown) to cylinder head ring 364.

In FIG. 3 the tubular member 212 and hub 45 can be connected to one another in sealed locking engagement by introducing a fluid into passage 326 through close port 390 to actuate the actuator ring 234 over the fingers 244 to move fingers 244 into tight clamping engagement with shoulders 254 and 256 and to sealingly engage seal ring 358 between surfaces 360 and 362 of member 212 and hub 45. After connection, the fluid in passage 326 can be vented. Referring to FIGS. 3 and 4, the tubular member 212 and hub 45 can be disconnected from one another by introducing a fluid into passage 326 through open port 401 to actuate the actuator ring 234 in the direction opposite the closing direction so as to release the fingers 244 from tight clamping engagement with shoulders 254 and 256. The connector 51, 52 can then be removed from hub 45.

Figure 5:
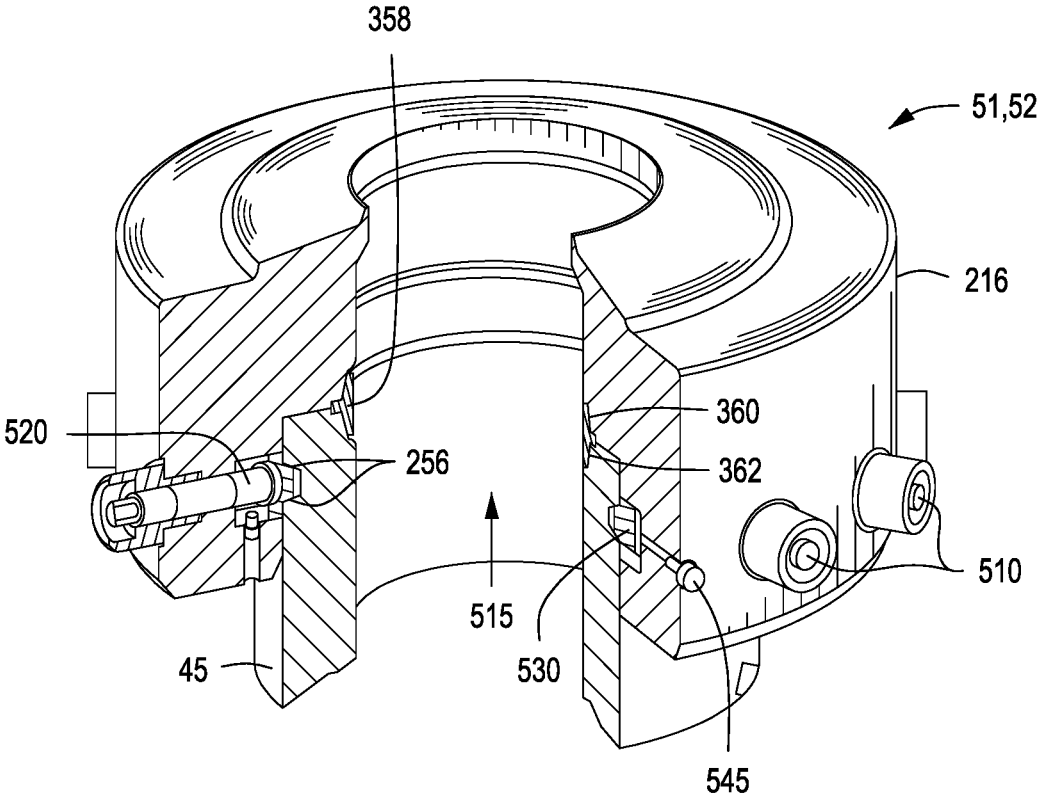
FIG. 5 depicts a section view of an illustrative dog in window type connector in its locking position, according to one or more embodiments provided herein.

FIG. 5 depicts a section view of an illustrative dog in window type connector in its locking position, according to one or more embodiments. As depicted, the connector 51, 52 is in its locking position joining housing 216 to hub 45. Housing 216 can contain threaded shafts or jack screws 520 with external interfaces 510 configured to accept tooling, not shown, for rotating the threaded shafts 520. The threaded shafts can be distributed approximately perpendicular to the axis of a thru bore 515 and about the housing 216. The threaded shafts 520 can engage one or more dogs, collets, or lock-ring segments 530 such that when the threaded shafts 520 are rotated the lock-ring segments 530 move in concert with the threaded shafts 520. One or more lubricant injection ports 545 can be distributed about the housing 216 and configured to deliver lubricant to the threaded shafts 520 and other moving parts as needed. The housing 216 and the hub 45 can be connected to one another in sealed locking engagement by the actuation of the threaded shafts 520 such that the lock-ring segments 530 are engaged with the hub 45 into tight clamping engagement with shoulder 256 and to sealingly engage seal ring 358 between surfaces 360 and 362 of housing 216 and hub 45.

Figure 6:
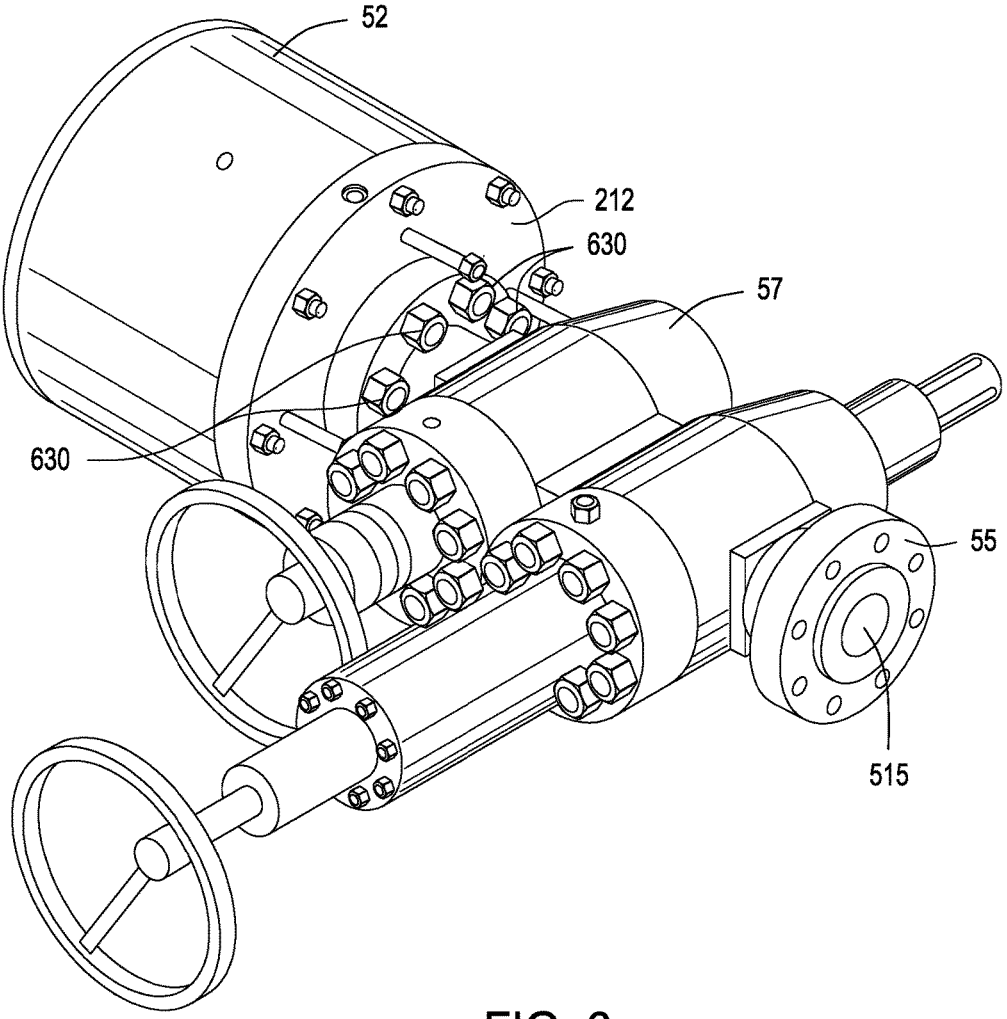
FIG. 6 depicts a three-dimensional view of an illustrative connector secured to an illustrative valve, according to one or more embodiments provided herein.

FIG. 6 depicts a three-dimensional view of an illustrative connector secured to an illustrative valve, according to one or more embodiments. As depicted, the illustrative valve can be the choke valve 57 and can be secured to the choke line connector 52 via bolts 630 prior to installation on a choke hub, not shown. The illustrative valve can be the kill valve 67 secured to the kill line connector 51 depicted in FIG. 1.

Figure 7:
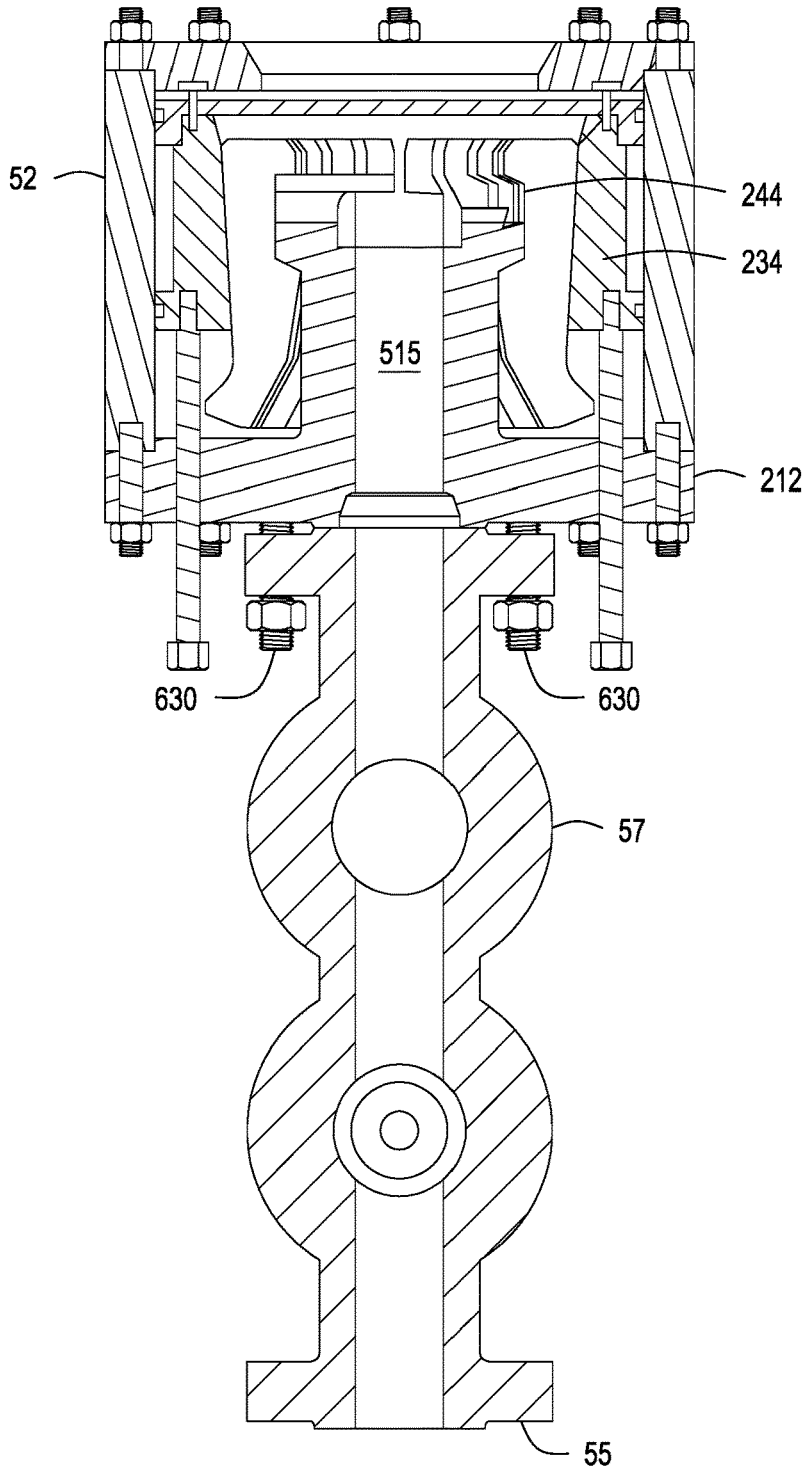
FIG. 7 depicts a section view of the illustrative connector secured to an illustrative valve, according to one or more embodiments provided herein.

FIG. 7 depicts a section view of the illustrative connector secured to an illustrative valve, according to one or more embodiments. As depicted, the choke valve 57 is secured to the member 212 on choke line connector 52 via bolts 630. The bolts 630 can be distributed about the choke line connector 52 such that by tightening the bolts 630, the choke valve 57 can be brought into tight clamping engagement with the choke line connector 52 to sealingly engage the through bore 515 of the choke valve 57 with the through bore 515 of the choke line connector 52. The through bore 515 can allow fluid flow through both the choke line connector 52 and the valve 57. The choke valve 57 can control fluid flow in the through bore 515. A similar configuration can be utilized for the kill valve 67 and connecter 51 as depicted in FIG. 1, such that the kill valve 67 can control fluid flow in the through bores disposed within the kill valve 67 and the kill line connector 51.

FIG. 8 depicts the illustrative wellbore stack secured to the wellbore during well drilling, well operations, or well workover, according to one or more embodiments. During well drilling, well operations, or well workover, depending on the configuration of the wellhead and casing strings, it may be necessary to nipple-down and nipple-up the BOP stack 30 as each casing string is run. To nipple-down means the process of disassembling well-control or pressure-control equipment, such as the BOP stack 30, from the wellbore 21. The disassembly can include the removal of a choke line assembly 830 and a kill line assembly 840 from the BOP stack 30. To nipple-up means the process of assembling the well-control equipment, the BOP stack 30, on the wellbore hub and can include reconnecting the choke line assembly 830 and the kill line assembly 840 to the BOP stack 30. The choke line assembly 830 can include the choke line 58 having a through bore sealingly engaged with a through bore of the choke valve 57 and a through bore of the choke line connector 52 such that the choke valve 57 can control fluid flow in the through bores. The kill valve assembly 840 can include the kill line 68 having a through bore sealingly engaged with a through bore of the kill valve 67 and a through bore of the kill line connector 51 such that the kill valve 67 can control fluid flow in the through bores.

During installation of the choke line assembly 830 to choke line hub 40 located on the BOP stack 30, the choke line assembly 830 can be structurally supported and the choke line connector 52 can be landed to the choke line hub 40. The connector 52 can be a hydraulically, electrically, or manually actuated connector. For a hydraulically operated choke line connecter 52, hydraulic close pressure can be applied from a reservoir 820 to the close port, not shown, of the hydraulically operated choke line connector 52 to sealing engage the choke line connector 52 onto the choke line hub 40. During installation of the kill line assembly 840 to kill line hub 45 located on the BOP stack 30, the kill line assembly 840 can be structurally supported and the kill line connector 51 can be landed to the kill line hub 45. The connector 51 can be a hydraulically, electrically, or manually actuated connector. For a hydraulically operated kill line connecter 51, hydraulic close pressure can be applied from a reservoir 820 to the close port, not shown, of the hydraulically operated kill line connector 51 to sealing engage the kill line connector 51 onto the kill line hub 45. The reservoir 820 and any supporting equipment can be integrated with the choke line assembly 830 and/or the kill line assembly 840. The connectors 51 and 52 can be actuated via electric signal and/or via manual operations.

During kill and/or choke operations, the choke line assembly 830 and the kill line assembly 840 can be installed. Killing procedures can include circulating reservoir fluids out of the wellbore 20 or by pumping higher density mud into the wellbore 20, or both. In the case of an induced kick, where the mud density is sufficient to kill the well but the reservoir has flowed as a result of pipe movement, the kill procedure can include circulating the influx out of the wellbore 20. In the case of an underbalanced kick, the kill procedure can include circulating the influx out of the wellbore 20 and increasing the density of the mud flowing into the wellbore 20. In the case of a producing well, the kill procedure can include pumping a kill fluid into the wellbore 20 where the kill fluid has sufficient density to overcome production of formation fluid out of the wellbore 20. Influx fluids or formation fluids can be circulated out of the wellbore 20 through the choke line assembly 830. The choke line assembly 830 can control wellbore 20 pressure, fluid flow rate out of the wellbore 20, or downstream fluid pressure. Higher density mud and/or kill fluid can be flowed into the wellbore 20 through the kill line assembly 840.

The kill line assembly 840 can be structurally supported while the kill line connector 51 is actuated to disengage from the kill line hub 45 and the kill line assembly 840 can be moved out of engagement with the kill line hub 45. In a similar fashion, the choke line assembly 830 can be structurally supported while the choke line connector 52 is actuated to disengage from the choke line hub 40 and the choke line assembly 830 can be moved out of engagement with the choke line hub 40. The BOP stack 30 can be moved off the wellbore 20 as needed.

Structural support of the kill line assembly 840 and the choke line assembly 830 can be accomplished by placing the assemblies 840 and/or 830 on a wheeled dolly, not shown, for transporting the assembly 830, and a similarly outfitted assembly 840, to and from the BOP stack 30. Structural support of the choke line assembly 830 and the kill line assembly 840 can be accomplished by installing either assembly in a housing, not shown. The housing can be placed on the wheeled dolly or can include a base 872 having wheels 874 installed thereunder for transporting the assembly 830, and a similarly outfitted assembly 840 not shown, to and from the BOP stack 30. The wheels 874 can be put in motion by motors, not shown. The housing can include a lifting attachment 810 for attaching a lifting interface 841 for lifting and/or moving the assembly 840, and a similarly outfitted assembly 830 not shown, to and from the BOP stack 30. The lifting interface 841 can be a hook, eye ring, or any attachment device that can be attached to the lifting attachment 810. The lifting interface 841 can include a lifting line 845 and a swing arm or crane 850. The lifting interface 841 and the lifting line 845 can be combined with or replaced by any combination of hooks, chains, wires, cables, and/or straps capable of supporting and/or lifting and/or moving the assemblies 830 and/or 840 to and from the BOP stack 30. The lifting interface 841 and the lifting line 845 can be used to support and/or lift and/or move at least a portion of the BOP stack 30. A control system, not shown, can be integrated with assemblies 830 and 840 for performing autonomous removal and installation operations of the assemblies 830 and 840.

Figure 9:
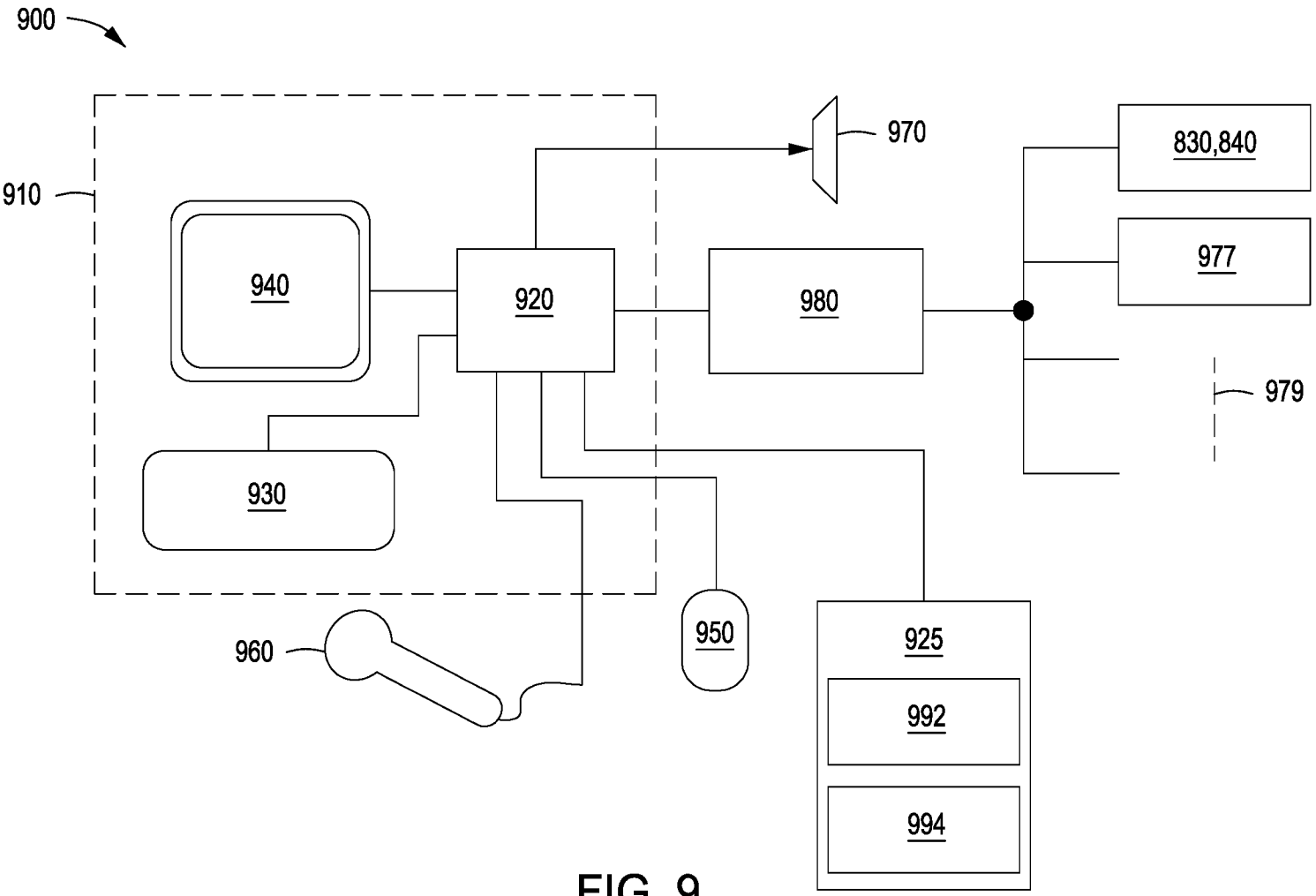
FIG. 9 depicts a control system for performing autonomous removal and installation operations of the kill line assembly and the choke line assembly, according to one or more embodiments provided herein.

FIG. 9 depicts a control system for performing autonomous removal and installation operations of the kill line assembly and the choke line assembly, according to one or more embodiments. The control system 900 can include one or more computers 910 that can include one or more central processing units 920, one or more input devices, touch actuation buttons, or keyboards 930, and one or more output devices 940 on which a software application can be executed. The one or more touch actuation panels can include a panel having mechanically actuated buttons for sending signals to perform certain operations such as opening or closing a connector or moving an assembly. The one or more computers 910 can also include one or more memories 925 as well as additional input and output devices, for example a mouse 950, one or more microphones 960, and one or more speakers 970. The mouse 950, the one or more microphones 960, and/or the one or more speakers 970 can be used for, among other purposes, universal access and voice recognition or commanding. The one or more output devices 940 can be touch-sensitive to operate as an input device as well as a display device.

The one or more computers 910 can interface with database 977, kill line assembly 830, choke line assembly 840, other databases and/or other processors 979, or the Internet via the interface 980. It should be understood that the term "interface" does not indicate a limitation to interfaces that use only Ethernet connections and refers to all possible external interfaces, wired or wireless. It should also be understood that database 977, kill line assembly 830, choke line assembly 840, and/or other databases and/or other processors 979 are not limited to interfacing with the one or more computers 910 using network interface 980 and can interface with one or more computers 910 in any means sufficient to create a communications path between the one or more computers 910 and database 977, kill line assembly 830, choke line assembly 840, and/or other databases and/or other processors 979. For example, in one or more embodiments, database 977 can interface with one or more computers 910 via a USB interface while kill line assembly 830, choke line assembly 840 can interface via some other high-speed data bus without using the network interface 980. The one or more computers 910, the kill line assembly 830, choke line assembly 840, and the other processors 979 can be integrated into a multiprocessor distributed system.

It should be understood that even though the one or more computers 910 is shown in FIG. 9 as a platform on which the methods discussed and described herein can be performed, the methods discussed and described herein could be performed on any platform. For example, the many and varied embodiments discussed and described herein can be used on any device that has computing capability. For example, the computing capability can include the capability to access communications bus protocols such that the user can interact with the many and varied computers 910, the kill line assembly 830, choke line assembly 840, and/or other databases and processors 979 that can be distributed or otherwise assembled. These devices can include, but are not limited to, supercomputers, arrayed server networks, arrayed memory networks, arrayed computer networks, distributed server networks, distributed memory networks, distributed computer networks, desktop personal computers (PCs), tablet PCs, hand held PCs, laptops, cellular phones, hand held music players, or any other device or system having computing capabilities.

Programs can be stored in the one or more memories 925 and the one or more central processing units 920 can work in concert with at least the one or more memories 925, the one or more input devices 930, and the one or more output devices 940 to perform tasks for the user. The one or more memories 925 can include any number and combination of memory devices, without limitation, as is currently available or can become available in the art. In one or more embodiments, memory devices can include without limitation, and for illustrative purposes only: database 977, other databases and/or processors 979, hard drives, disk drives, random access memory, read only memory, electronically erasable programmable read only memory, flash memory, thumb drive memory, and any other memory device. Those skilled in the art are familiar with the many variations that can be employed using memory devices and no limitations should be imposed on the embodiments herein due to memory device configurations and/or algorithm prosecution techniques.

The one or more memories 925 can store an operating system (OS) 992, and a kill and choke line assembly operations agent 994. The operating system 992 can facilitate control and execution of software using the one or more central processing units 920. Any available operating system can be used in this manner including WINDOWS™, LINUX™, Apple OS™, UNIX™, and the like.

The one or more central processing units 920 can execute either from a user request or automatically. In one or more embodiments, the one or more central processing units 920 can execute the kill and choke line assembly operations agent 994 when a user requests, among other requests, to move and/or operate one or more kill line assemblies and one or more choke line assemblies. The kill and choke line assembly operations agent 994 can control actuation of connectors of the kill line assembly 830 and/or the choke line assembly 840 shown in FIG. 8 above. The kill and choke line assembly operations agent 994 can control connection and disconnection of the kill line assembly 830 and/or the choke line assembly 840.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

What is claimed is:

1. A method for drilling and producing a surface wellbore, comprising drilling a conductor pipe borehole;

installing a conductor pipe within the conductor pipe borehole;

installing a drilling flange onto the conductor pipe;

assembling a wellhead stack on the drilling flange, wherein the wellhead stack comprises:

two or more blow out preventers, a kill line hub secured to and in fluid communications with a first spool located below a first blowout preventer, a choke line hub secured to and in fluid communications with a second spool located between a second blowout preventer and the first blow out preventer, a choke line, and a kill line, wherein both the kill line and choke line each have a quick connect collet connector;

landing the kill line collet connector on the kill line and the choke line collet connector on the choke line hub;

actuating each collet connector to bring a throughbore in the choke line hub and the kill line hub into sealing engagement with each collet connector throughbore; and drilling a wellbore by introducing a drill head and drill string into the conductor pipe borehole, rotating the drill string, removing the drill string and drill head, installing casing, cementing the casing, and plugging the bottom of the casing.

2. The method of claim 1, further comprising:

measuring formation pressure;

discontinuing drilling if the measured formation pressure exceeds a mud pressure;

closing at least one of the blowout preventers;

introducing drilling mud through the kill line to stabilize the downhole pressure and to flow the pressure differential out of the wellbore; and restarting drilling.

3. The method of claim 1, wherein a control system is used for autonomous removal and installation of the kill line assembly and the choke line assembly.

4. The method of claim 1, wherein the kill line connector is hydraulically actuated.

5. The method of claim 1, wherein the choke line connector is hydraulically actuated.

6. The method of claim 1, wherein the kill line connector is electrically actuated.

7. The method of claim 1, wherein the choke line connector is electrically actuated.

* * * * *